US010041661B2

(12) United States Patent
Garza

(10) Patent No.: US 10,041,661 B2
(45) Date of Patent: Aug. 7, 2018

(54) ILLUMINATION SYSTEM AND METHOD

(71) Applicant: David M. Garza, San Antonio, TX (US)

(72) Inventor: David M. Garza, San Antonio, TX (US)

(73) Assignee: Penguin Lites, LLC, San Antonio, TX (US)

( * ) Notice: Subject to any disclaimer, the term of this patent is extended or adjusted under 35 U.S.C. 154(b) by 500 days.

(21) Appl. No.: 14/923,173

(22) Filed: Oct. 26, 2015

(65) Prior Publication Data

US 2017/0082272 A1 Mar. 23, 2017

Related U.S. Application Data

(63) Continuation of application No. 29/540,151, filed on Sep. 21, 2015.

(51) Int. Cl.

| | |
|---|---|
| ***F21V 21/30*** | (2006.01) |
| ***F21V 23/04*** | (2006.01) |
| ***F21S 8/00*** | (2006.01) |
| ***F21S 9/02*** | (2006.01) |

(52) U.S. Cl.

CPC ..... *F21V 21/30* (2013.01); *F21S 8/033* (2013.01); *F21S 9/02* (2013.01); *F21V 23/0464* (2013.01); *F21V 23/0471* (2013.01)

(58) Field of Classification Search

CPC .. F21V 21/30; F21V 23/0471; F21V 23/0464; F21S 8/033; F21S 9/02

See application file for complete search history.

(56) References Cited

U.S. PATENT DOCUMENTS

| | | | |
|---|---|---|---|
| D290,884 | S | 7/1987 | Sano |
| D321,865 | S | 11/1991 | Derocher |
| D327,334 | S | 6/1992 | Parker |
| D332,839 | S | 1/1993 | Beckner |
| D343,469 | S | 1/1994 | Yuen |
| D477,432 | S | 7/2003 | Parsons |
| D526,734 | S | 8/2006 | Brown |
| D527,129 | S | 8/2006 | Hodgson |
| D590,532 | S | 4/2009 | Levine |
| D604,435 | S | 11/2009 | Kingston |
| D604,871 | S | 11/2009 | Denton |
| D614,334 | S | 4/2010 | Thomson |
| D615,681 | S | 5/2010 | Thomson |
| D618,831 | S | 6/2010 | Pennington |
| D630,355 | S | 1/2011 | Gulker |
| D645,179 | S | 9/2011 | Gulker |
| D656,646 | S | 3/2012 | Kawase |
| D656,647 | S | 3/2012 | Hodgson |
| D695,434 | S | 12/2013 | Shen |
| D703,356 | S | 4/2014 | Grandadam |

(Continued)

*Primary Examiner* — Thomas M Sember

(74) *Attorney, Agent, or Firm* — Polsinelli PC; Adam C. Rehm

(57) ABSTRACT

An illumination device that is retrofittable to a wall, and configured to emit light in a downward direction relative to the wall, upon detection of motion, if a degree of ambient light is below a predetermined threshold. The illumination device is reconfigurable to adapt or conform to a variety of surface contours so that the illumination device may be flush-mounted to the wall. The illumination device includes a theft-deterrent design to prevent or deter removal of the illumination device from a wall mount.

13 Claims, 8 Drawing Sheets

(56) References Cited

U.S. PATENT DOCUMENTS

| | | | | |
|---|---|---|---|---|
| D703,357 | S | 4/2014 | Grandadam | |
| D743,594 | S | 11/2015 | Scazziga | |
| D766,477 | S | 9/2016 | Ma | |
| D791,379 | S | 7/2017 | Koshiba | |
| 2005/0190551 | A1* | 9/2005 | Rempel | F21L 14/02<br>362/162 |
| 2016/0215966 | A1* | 7/2016 | Heller | A45D 44/04 |

* cited by examiner

ILLUMINATION SYSTEM AND METHOD

CROSS-REFERENCE TO RELATED APPLICATIONS

This application is a continuation-in-part of U.S. patent application Ser. No. 29/540,151, titled NIGHTLIGHT WITH JOINT, and filed Sep. 21, 2015, the contents of which are incorporated herein by reference in its entirety.

BACKGROUND

1. Field of the Invention

The present inventive concept relates to an illumination system and method, and more specifically to an illumination device that is retrofittable to a wall, and configured to emit light in a downward direction relative to the wall, upon detection of motion, if a degree of ambient light is below a predetermined threshold.

2. Description of Related Art

Lighting devices are commonly used to illuminate enclosed spaces of a home at night. Conventional night lights are plugged in to an electrical outlet, and provide a relatively small amount of light suitable for illuminating a pathway adjacent to the outlet when other light sources, e.g., overhead lights, are off. Conventional night lights are useful for providing enough light to move around a user's home, without using other light sources that could interfere with other occupants who may be sleeping. Conventional night lights generally must be manually switched on and off each time a user desires use thereof.

The necessity to use an electrical outlet is undesirable because such restricts where a night light can be placed, prevents flush-mounting of the night light to a mounting surface, and allows for easy removal and theft of the night light. Further, the necessity to manually switch a night light on and off each time a user desires to use the night light is undesirable because the user may forget to switch the night light on or off, which could result in a dangerous, unlit pathway or wasted energy as the night light stays on during non-use periods of time and/or periods of time when there is sufficient illumination, e.g., due to daylight or overhead lights.

Thus, there is a need for an illumination system and method which may be used irrespective of any electrical outlet placement restrictions, is configurable to accommodate and adapt to a variety of mounting surfaces for flush mounting thereto, includes a theft-deterrent design, and does not require manual activation or deactivation, thereby avoiding dangerous, unlit pathways and wasted energy.

SUMMARY OF THE INVENTION

The present inventive concept eliminates the aforementioned problems associated with conventional lighting devices and existing enclosures with insufficient lighting. The present inventive concept provides an illumination device that is retrofittable to a wall, and configured to emit light in a downward direction relative to the wall, upon detection of motion, if a degree of ambient light is below a predetermined threshold. The illumination device is reconfigurable to adapt or conform to a variety of surfaces so that the illumination device may be flush-mounted thereto. The illumination device includes a theft-deterrent design to prevent or deter removal of the illumination device from a wall mount.

The aforementioned may be achieved in one aspect of the present inventive concept by providing a retrofit illumination device. The device may be a reconfigurable housing operable to assume one of a plurality of configurations. The housing may include a plurality of sections connected via a connector, and/or configured to allow one of the plurality of sections to rotate relative to another one of the plurality of sections. The device may include at least one illumination element that may be disposed at least partially within, entirely within, or on a surface of the housing. The device may be operable to emit light in at least one direction, and/or be operable to receive power from a power source.

The plurality of sections of the housing may include two sections. The at least one illumination element may include a plurality of illumination elements on each of the two sections. Each of the plurality of illumination elements may include a visor operate to limit light emitted by its respective one of the plurality of illumination elements.

The device may include a lens operable to enclose one or more of the plurality of illumination elements. The device may include a motion sensor disposed at least partially in the housing. The motion sensor may be operable to (i) detect motion within a predetermined proximity to the device, and/or (ii) generate a motion detection signal to cause one or more of the plurality of illumination elements to emit light if motion is detected. The motion sensor may be configured to stop generating the motion detection signal if the motion is not detected after a predetermined period of time to cause the one or more of the plurality of illumination elements to stop emitting light.

The device may include an ambient light sensor disposed at least partially in the housing. The ambient light sensor may be operable to (i) detect ambient light within a predetermined proximity to the device, and/or (ii) generate a light detection signal to cause one or more of the plurality of illumination elements to emit light if the ambient light becomes less than a predetermined level. The ambient light sensor may be configured to stop generating the light detection signal if the ambient light becomes greater than the predetermined level to cause the one or more of the plurality of illumination elements to stop emitting light.

The plurality of configurations may include a first configuration with the sections extended from the connector at a forty-five degree angle relative to each other so that at least one of the plurality of lights on each of the sections is operable to emit light toward a single point in front of the at least one of the plurality of lights. The plurality of configurations may include a first configuration with the sections extended from the connector at a forty-five degree angle relative to each other so that at least one of the plurality of lights on each of the sections is operable to emit light entirely away from a single point behind the at least one of the plurality of lights.

The plurality of configurations may include at least two configurations with the sections extended from the connector at a forty-five degree angle relative to each other. One of the at least two configurations may enable or cause each of the plurality of lights to emit light away from each other, when the device is activated and the plurality of lights are emitting light. Another one of the two configurations may enable each of the plurality of lights to emit light toward each other, when the device is activated and the plurality of lights are emitting light. In this manner, the device may be mounted to wrap around and/or fit into a corner of a wall.

The power source may be a battery housed in a compartment within the housing and accessible via an access panel having a security feature, or may be an external power source, e.g., a power source accessed via a wireless connection or wired connection. The access panel may be operable to be slidably secured to a wall mount. The wall mount may include a security feature operable to deter theft of the device or restrict the number of directional forces able to separate the device from the wall mount if applied to the device. Each of the plurality of sections of the reconfigurable housing may be configured to conform to a contour defined by a mounting surface of the device.

The aforementioned may be achieved in one aspect of the present inventive concept by providing a method of retrofitting an illumination device to a wall. The method may include the step of configuring a reconfigurable housing based on a contour of a wall. The method may include the step of mounting the housing on the wall. The housing may be operable to assume one of a plurality of configurations. The housing may include a plurality of sections (i) connected via a connector, and/or (ii) configured to allow one of the plurality of sections to rotate relative to another one of the plurality of sections. The housing may include at least one illumination element operable to emit light in at least one direction.

Other systems, methods, features, and advantages of the present inventive concept will be or will become apparent to one with skill in the art upon examination of the following figures and detailed description. It is intended that all such additional systems, methods, features, and advantages be included within this description, be within the scope of the present inventive concept, and be protected by the accompanying claims.

BRIEF DESCRIPTION OF THE DRAWINGS

The accompanying figures, which are incorporated in and constitute a part of this specification, illustrate an implementation of the present inventive concept and, together with the description, serve to explain the advantages and principles of the present inventive concept. In the figures.

The figures do not limit the present inventive concept to the specific examples disclosed and described herein, and are not necessarily to scale.

DETAILED DESCRIPTION OF THE INVENTION

The following detailed description references the accompanying figures that illustrate the present inventive concept. The illustrations and description are intended to describe aspects of the present inventive concept in sufficient detail to enable those skilled in the art to practice the present inventive concept. Other components can be utilized and changes can be made without departing from the scope of the present inventive concept. The following detailed description is, therefore, not to be taken in a limiting sense. The scope of the present inventive concept is defined only by the appended claims, along with the full scope of equivalents to which such claims are entitled.

In this description, references to an "embodiment" or "embodiments" mean that the feature or features being referred to are included in at least one embodiment of the present inventive concept. Separate references to an "embodiment" or "embodiments" do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present inventive concept can include a variety of combinations and/or integrations of the embodiments described herein.

Figure 1:
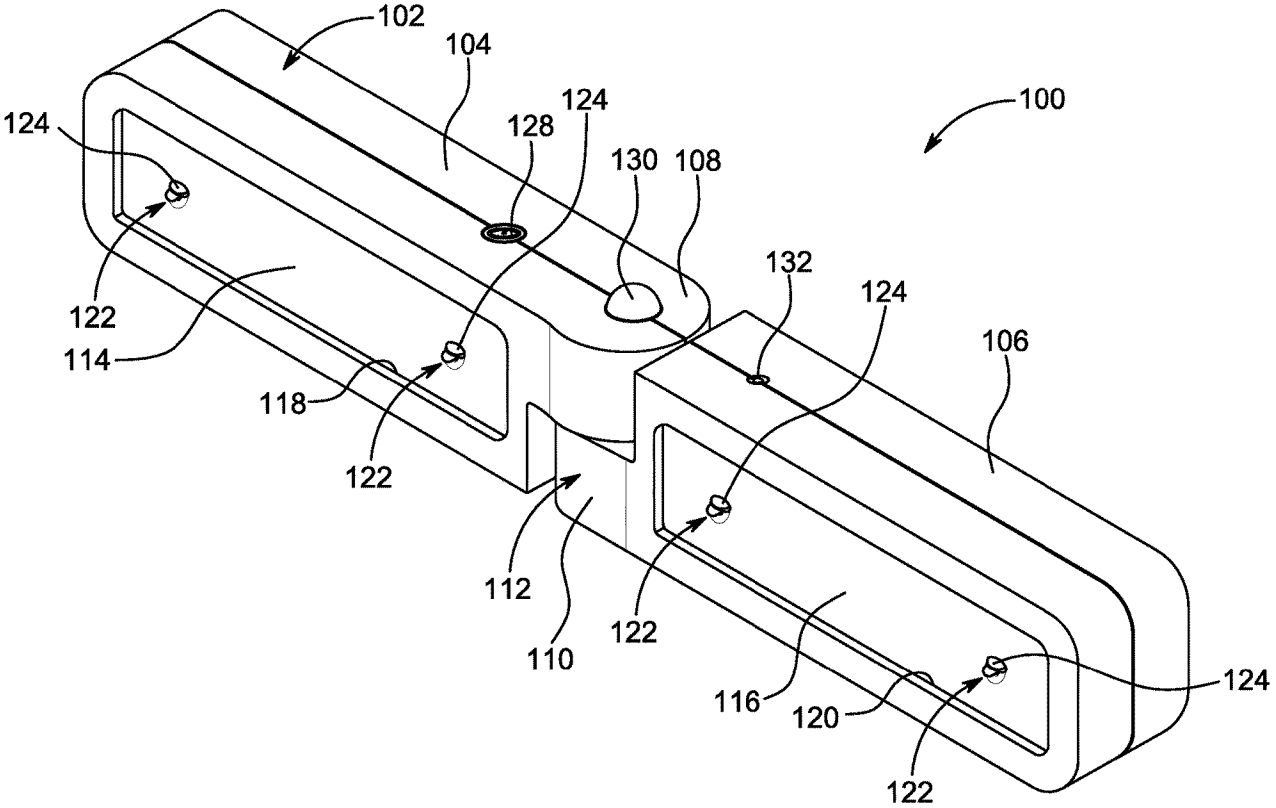
FIG. 1 is a front perspective view of an illumination device in accordance with the present inventive concept.
Figure 2:
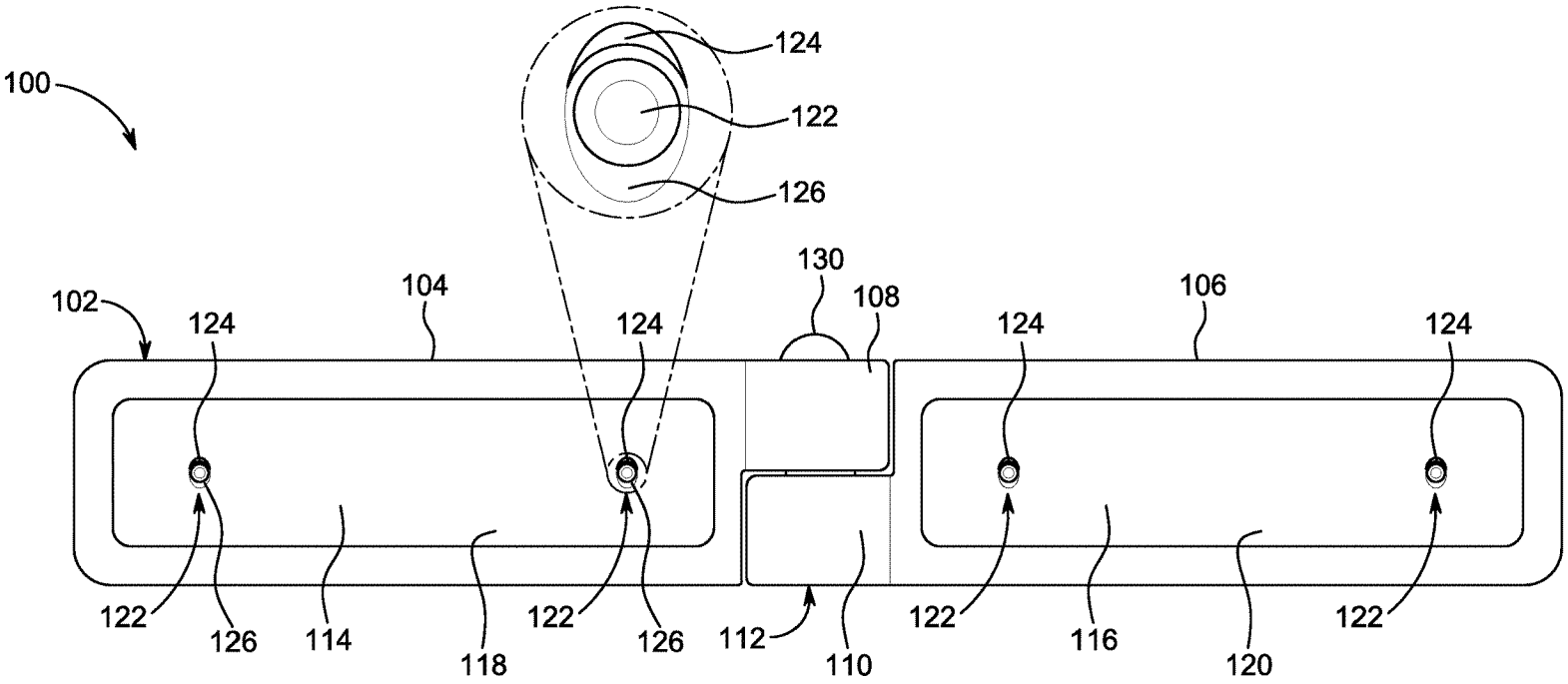
FIG. 2 is a front elevational view of the illumination device of FIG. 1.
Figure 3:
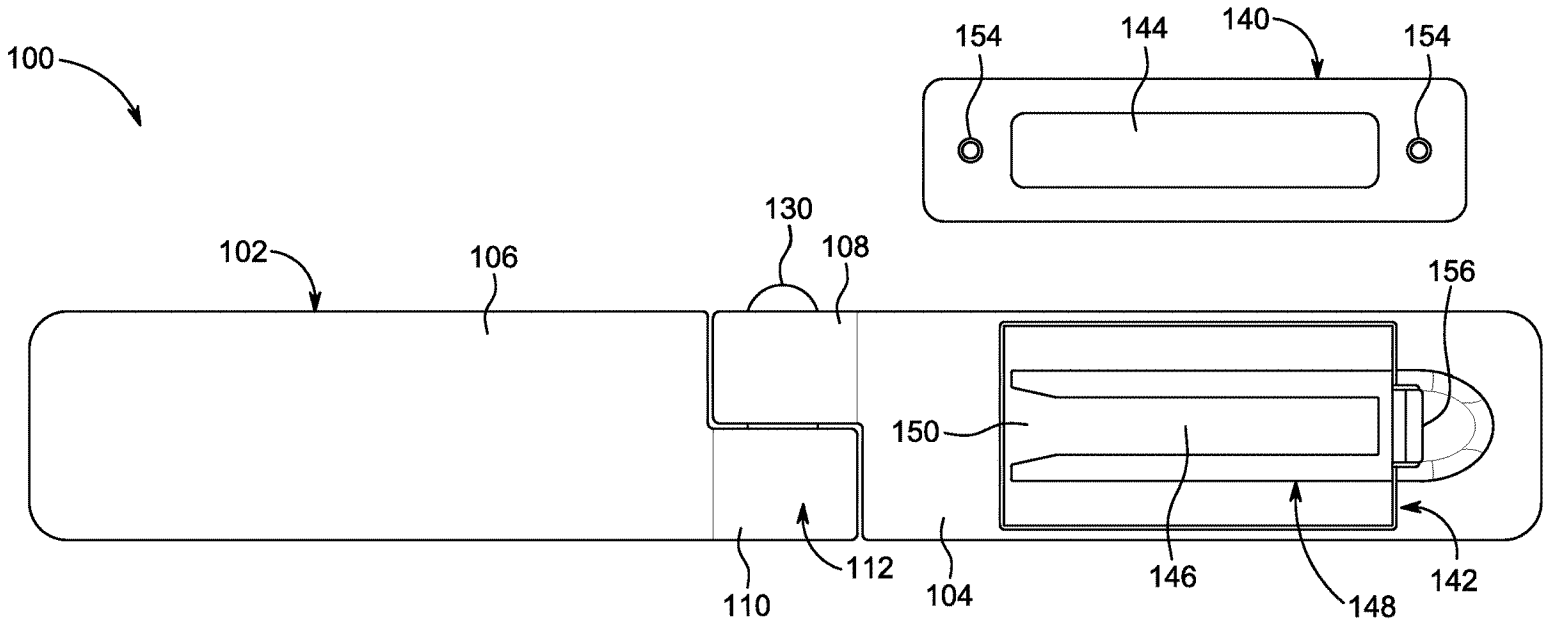
FIG. 3 is a rear elevational exploded view of the illumination device of FIG. 1, with a mounting plate removed from a rear of a housing of the illumination device with abutting surfaces of the mounting plate and the housing illustrated.
Figure 4:
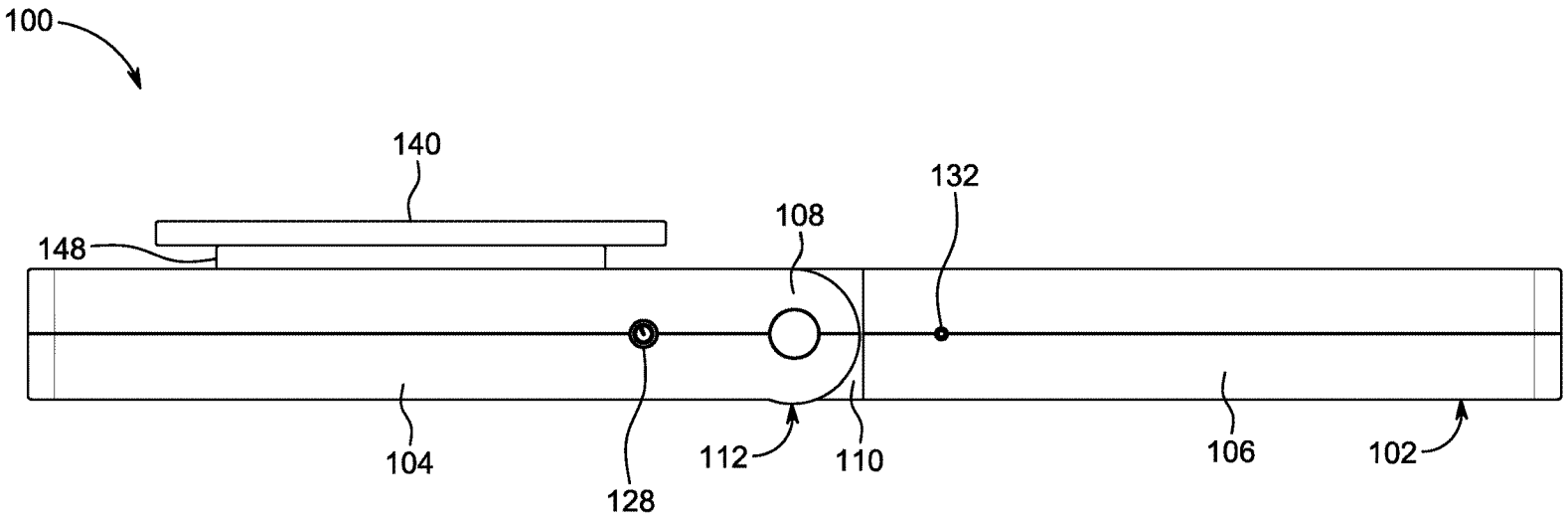
FIG. 4 is a top plan view of the illumination device of FIG. 1.
Figure 5:
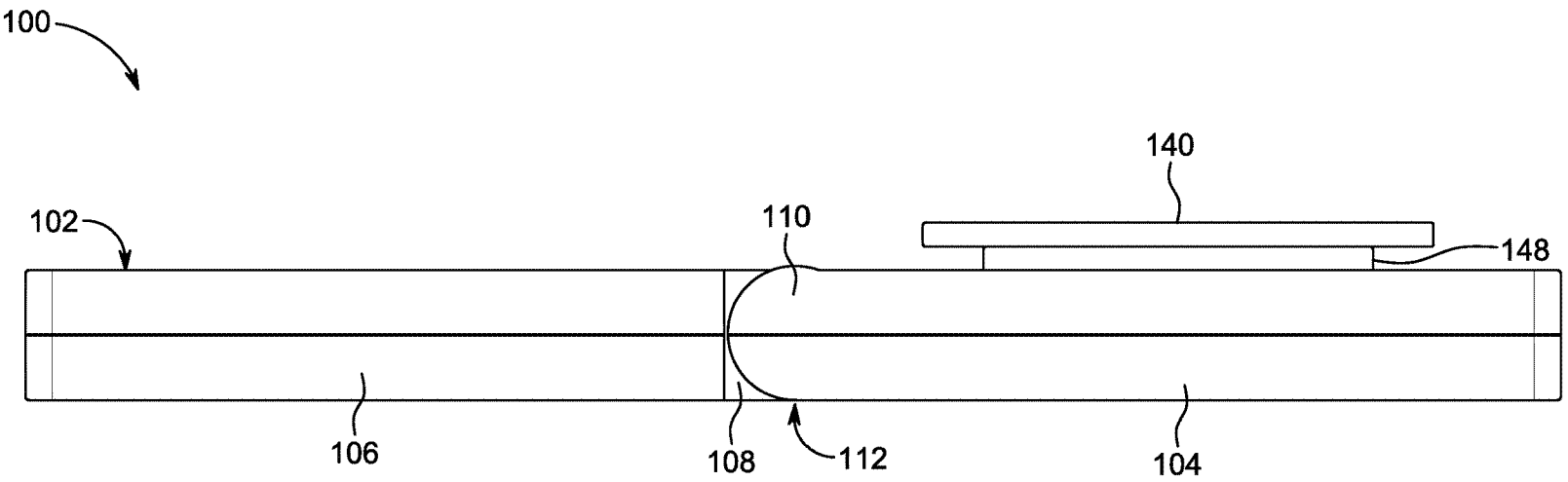
FIG. 5 is bottom plan view of the illumination device of FIG. 1.
Figure 7:
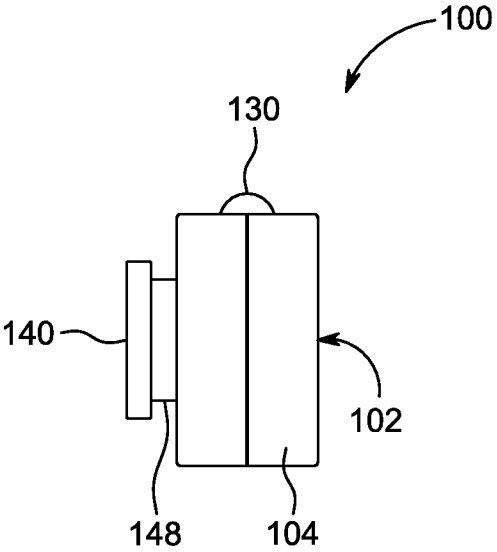
FIG. 7 is a left side elevational view of the illumination device of FIG. 1.
Figure 6:
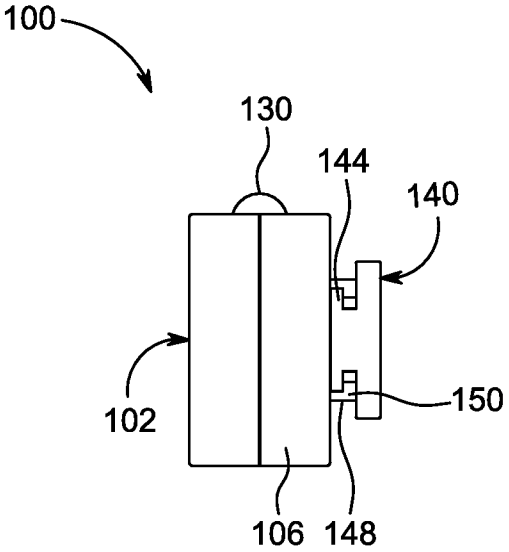
FIG. 6 is a right side elevational view of the illumination device of FIG. 1.

Referring now to FIGS. 1 and 2, a preferred embodiment of a retrofit illumination device 100 is illustrated. In the presently preferred embodiment, the illumination device 100 includes a rectangular housing 102 having a plurality of sections, i.e., a first section 104 and a second section 106. In the preferred embodiment, the housing 102 is rectangular and made of plastic, but it is foreseen that the housing 102 may be any shape, e.g., circular, square, oval, or the like, and made of any material, e.g., metal, glass, wood, and/or a combination of plastic, metal, glass, and/or wood, without deviating from the scope of the present inventive concept.

Each of the first section 104 and the second section 106 of the housing 102 includes a respective one of connector arms 108, 110, and are rotatably connected to each other by the connector arms 108, 110. The connector arms 108, 110 collaboratively function as a connector 112. In the preferred embodiment, the connector 112 are secured together via the connector arms 108, 110, but it is foreseen that the connector 112 may utilize any connection means, e.g., a hinge, hub, resilient element, and/or the like, without deviating from the scope of the present inventive concept.

Each of the first section 104 and the second section 106 of the housing 102 includes a respective one of rectangular lenses 114, 116, which define respective cavities 118, 120. In the preferred embodiment, the lenses 114, 116 are transparent and flat, and are not capable of filtering any light, but it is foreseen that the lenses 114, 116 may partially transparent, non-flat, and/or operable to filter light, e.g., different wavelengths of light, without deviating from the scope of the present inventive concept. The cavities 118, 120 are entirely enclosed by the lenses 114, 116 and nested portions of the housing 102. Each of the cavities 118, 120 includes at least one light emitting element 122. In the preferred embodiment, each of the cavities 118, 120 includes two light emitting elements 122, but it is foreseen that only one, three, or any number of the light emitting elements 122 may be included in each of the cavities 118, 120, and/or differing numbers of the light emitting elements 122 may be included in each of the cavities 118, 120, without deviating from the scope of the present inventive concept.

Each of the light emitting elements 122 is partially nested within the housing 102 and includes a visor 124 extending entirely over an upper portion of each of the light emitting elements 122. In this manner, light emitted upward from each of the light emitting elements 122 is operable to be blocked and reflected downward by each respective one of the visors 124.

Each of the light emitting elements 122 is partially nested within the housing 102 and partially surrounded by a nested portion 126 of the housing 102 that is operable to act as a reflector. In this manner, light emitted from each of the light emitting elements 122 is operable to be reflected and focused, in a direction defined by a central axis of each of the light emitting elements 122, by each respective one of the nested portions 126.

On a side of the housing 102 is a power switch 128 that is configured to allow a user to manually and selectively activate and deactivate the device 100. Also on the side of the housing 102 are a plurality of sensors, e.g., a motion sensor 130 and a light sensor 132. In the preferred embodiment, the switch 128, the motion sensor 130, and the light sensor 132 are on the same side of the housing 102, but it is foreseen that the switch 128, the motion sensor 130, and/or the light sensor 132 may be on different sides of the housing 102, without deviating from the scope of the present inventive concept.

The motion sensor 130 is disposed at least partially in the housing 102, and is operable to (i) detect motion within a predetermined proximity to the device 100, and (ii) generate a motion detection signal to cause one or more of the light emitting elements 122 to emit light if motion is detected. The motion sensor 130 is configured to stop generating the motion detection signal if the motion is not detected after a predetermined period of time to cause the one or more of the light emitting elements 122 to stop emitting light.

The light sensor 132 is configured to detect ambient light and is disposed at least partially in the housing 102. The light sensor 132 is operable to (i) detect ambient light within a predetermined proximity to the device 100, and (ii) generate a light detection signal to cause one or more of the light emitting elements 122 to emit light if the ambient light becomes less than a predetermined level. The light sensor 132 is configured to stop generating the light detection signal if the ambient light becomes greater than the predetermined level to cause the one or more of the light emitting elements 122 to stop emitting light Referring now to FIGS. 3 through 7, a mounting plate 140 and power source access lid 142 are illustrated. The mounting plate 140 includes a male portion 144 that is sized and shaped to be slidably received by a female portion 146 of a receiver 148 on a rear side of the housing 102. The mounting plate 140 may only be slidably received at one end 150 of the female portion 146 of the receiver 148. The one end 150 includes tapered portions 152 to facilitating mating of the mounting plate 140 with the receiver 148 of the housing 102. Once the mounting plate 140 is mated with the receiver 148, the mounting plate 140 can only be removed or disconnected from the receiver 148 by sliding the mounting plate 140 in a single direction, i.e., toward the one end 150 of the female portion 146 of the receiver 148. Because the mounting plate 140 is substantially concealed by the housing 102 when mounted to a wall or the like, theft of the device 100 is deterred and possibly prevented, thereby providing a theft-deterrent feature. The mounting plate 140 includes mount holes 154 that are sized and shaped to at least partially receive a screw or the like to enable mounting the device 100 to a surface of a wall or the like.

The power source access lid 142 includes a resilient lock and release tab 156 that is operable to be depressed and allow separation of the power source access lid 142 from the housing 102. Once the power source access lid 142 is separated from the housing 102, a power source, e.g., a battery compartment is exposed and accessible so that one or more batteries may be installed therein and/or removed therefrom, e.g., for replacement purpose. In the preferred embodiment, the power source of the device 100 includes two "AA" batteries, but it is foreseen that any number and/or type of battery may be used to power the device 100 without deviating from the scope of the present inventive concept. It is also foreseen that the device 100 may be powered by a wired connection or wirelessly, e.g., via a wireless connection, to an external power source, without deviating from the scope of the present inventive concept. In such a scenario, the device 100 may be powered by the external power source and include an internal power source operable to power the device 100 if the external power source fails to provide or otherwise stops providing power to the device 100. Further, because the resilient tab 156 is substantially concealed by the mounting plate 140 when the mounting plate 140 is connected to the receiver 148, access to the resilient tab 156, e.g., for removal of the power source access lid 142, is blocked. In this manner, theft of the power source is deterred and possibly prevented, and the device 100 includes another theft-deterrent feature.

Figure 8:
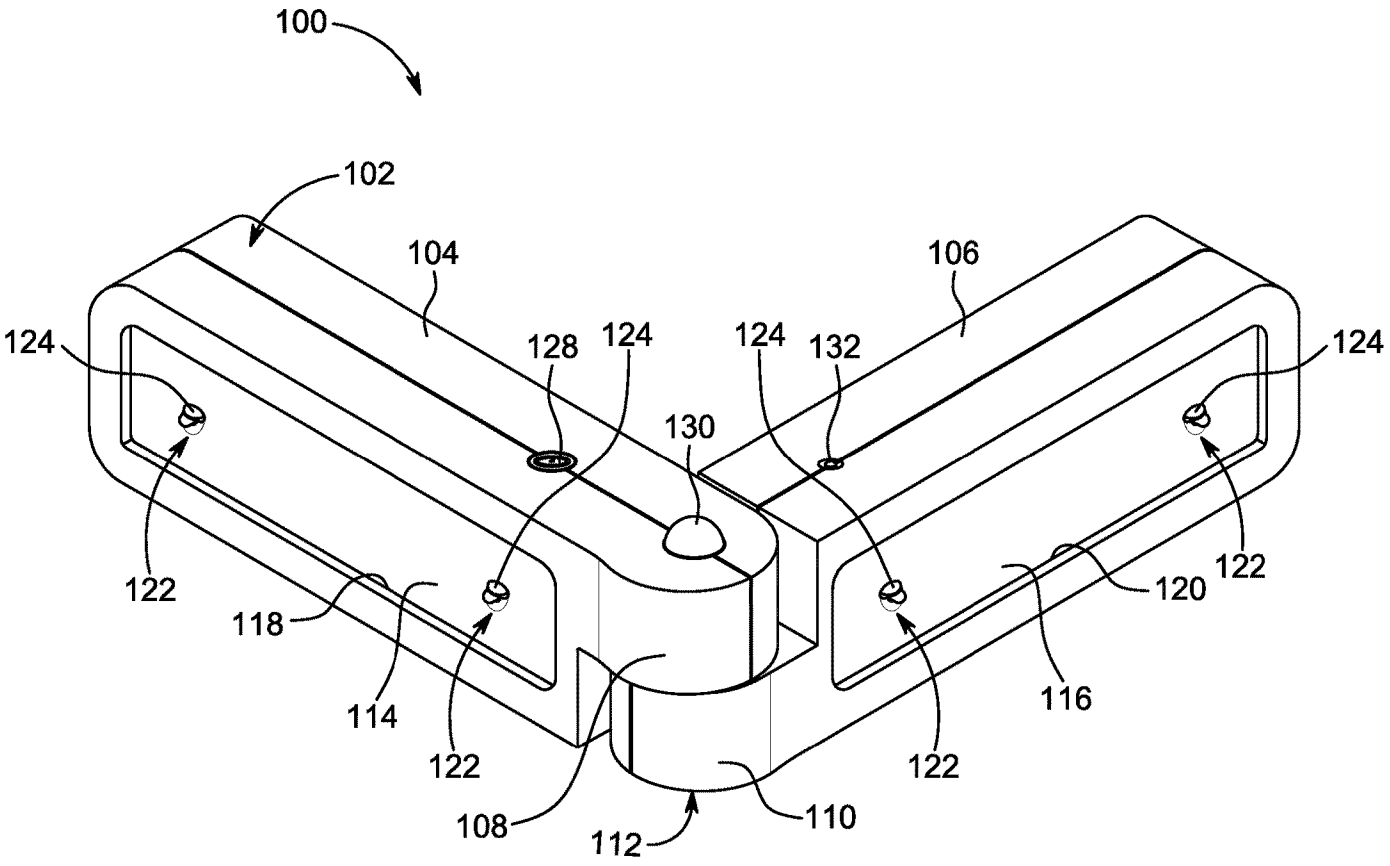
FIG. 8 is front perspective view of the illumination device of FIG. 1 in a first configuration of a plurality of configurations.
Figure 9:
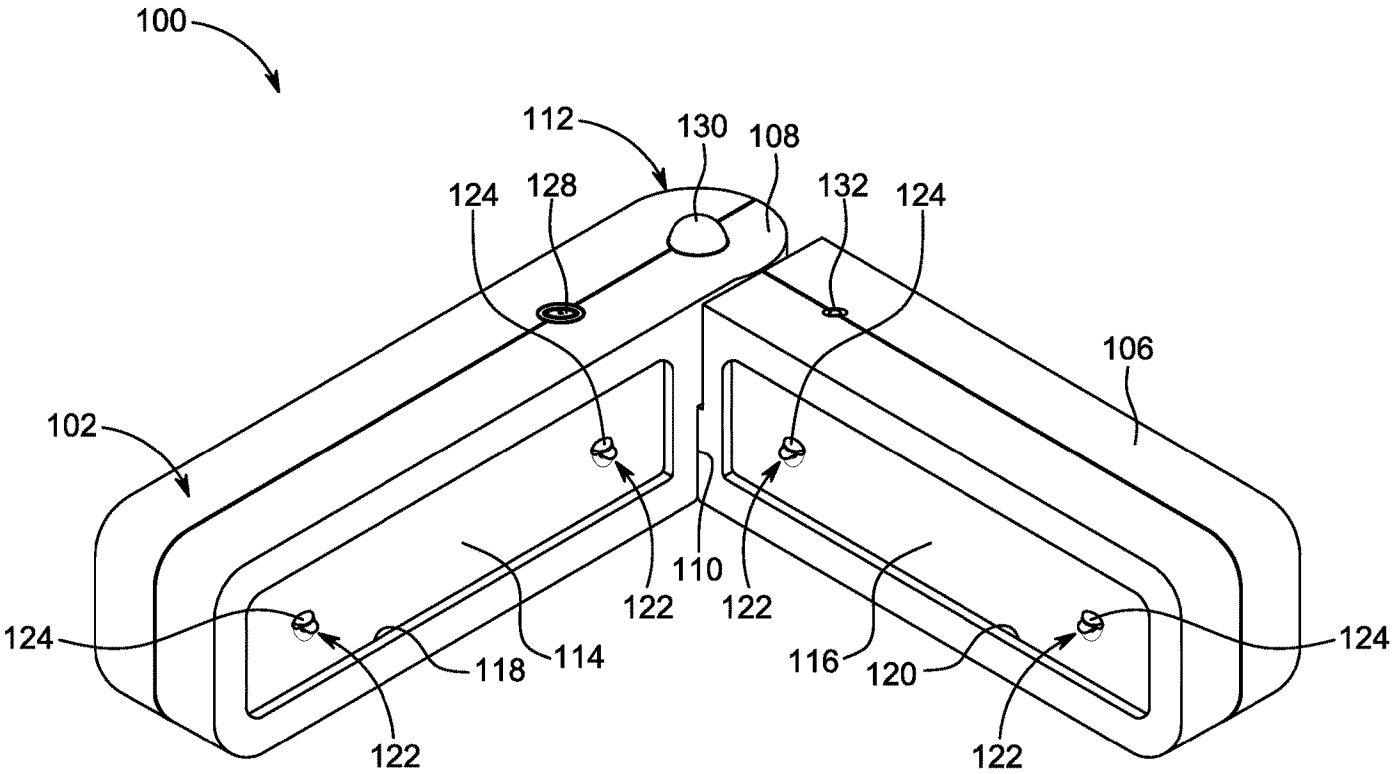
FIG. 9 is front perspective view of the illumination device of FIG. 1 in a second configuration of a plurality of configurations.

The device 100 may be configured in one of a plurality of configurations by rotating the first section 104 relative to the second section 106 of the housing 102 via the connector 112, as illustrated by FIGS. 8 and 9. The connector 112 defines maximum degrees of rotation in each direction, i.e., with the sections 104, 106 at a forty-five degree angle relative to each other. The device 100 configured to assume any configuration between the maximum degrees of configuration or one of the maximum degrees of rotation.

For instance, in one of the plurality of configurations, the sections 104, 106 are rotated to extend from the connector 112 at a forty-five degree angle relative to each other so that each of the plurality of light emitting elements 122 are operable to emit light in a direction that is substantially perpendicular to a direction of emitted light of at least one other of the plurality of light emitting elements 122, as illustrated by FIG. 9. Further and in another one of the plurality of configurations, The plurality of configurations includes two configurations with the sections 104, 106 extended from the connector 112 at a forty-five degree angle relative to each other, with one of the two configurations enabling each of the plurality of light emitting elements 122 to emit light away from each other and another one of the two configurations enabling each of the plurality of light emitting elements 122 to emit light toward each other. For instance, the plurality of configurations includes a first configuration with the sections 104, 106 extended from the connector 112 at a forty-five degree angle relative to each other so that at least one of the plurality of light emitting elements 122 on each of the sections 104, 106 is operable to emit light (i) toward a single point in front of the at least one of the plurality of light emitting elements 122, or (ii) entirely away from a single point behind the at least one of the plurality of light emitting elements 122. The points are imaginary points spaced along a central axis defined by each of the plurality of light emitting elements 122 that are in front of and behind each of the plurality of light emitting elements 122. In this manner, the device 100 may be configured to follow the contour of a wall and/or adjoining walls, e.g., walls that adjoin to form a corner anywhere including and between zero and one-hundred and eighty degrees, thereby enabling flush mounting of the device 100 to the wall(s). To mount the device 100 to a wall, a user attaches the mounting plate 140 to the wall via one or more screws or the like, configures the device 100 to follow a contour of the wall, slidably attaches the device 100 to the mounting plate, and activates the device 100 via the power switch 128. In this manner, the device 100 is retrofittable to a wall by adapting or conforming to a contour of the wall, and configured to emit light in a downward direction to illuminate an area adjacent to the wall, upon detection of motion, if a degree of ambient light is below a predetermined threshold.

Having now described the features, discoveries, and principles of the present disclosure, the manner in which embodiment of the present disclosure are constructed and used, the characteristics of the construction, and advantageous, new and useful results obtained; the new and useful structures, devices, elements, arrangements, parts and combinations, are set forth in the appended claims.

The following claims are intended to cover all of the generic and specific features of the present disclosure herein described, and all statements of the scope of the present inventive concept, which, as a matter of language, might be said to fall there between.

What is claimed is:

1. A retrofit illumination device comprising:

a reconfigurable housing operable to assume one of a plurality of configurations, the housing having a plurality of sections (i) connected via a connector, and (ii) configured to allow one of the plurality of sections to rotate relative to another one of the plurality of sections; and at least one illumination element (i) disposed at least partially within the housing, (ii) operable to emit light in at least one direction, and (iii) operable to receive power from a a power source; wherein the plurality of sections of the housing includes two sections, and the at least one illumination element includes a plurality of illumination elements on each of the two sections; wherein the plurality of configurations includes two configurations with the sections extended from the connector at a forty-five degree angle relative to each other, with one of the two configurations enabling each of the plurality of lights to emit light away from each other and another one of the two configurations enabling each of the plurality of illumination elements to emit light toward each other; wherein the power source is a battery housed in a compartment within the housing and accessible via an access panel having a security feature, and the access panel is operable to be secured to a wall mount.

2. The device of claim 1, wherein, each of the plurality of illumination elements include a visor operable to limit light emitted by its respective one of the plurality of illumination elements.

3. The device of claim 1, further comprising:

a lens operable to enclose one or more of the plurality of illumination elements.

4. The device of claim 1, further comprising:

a motion sensor disposed at least partially in the housing, and operable to (i) detect motion within a predetermined proximity to the device, and (ii) generate a motion detection signal to cause one or more of the plurality of illumination elements to emit light if motion is detected.

5. The device of claim 1, wherein, the motion sensor is configured to stop generating the motion detection signal if the motion is not detected after a predetermined period of time to cause the one or more of the plurality of illumination elements to stop emitting light.

6. The device of claim 1, further comprising:

an ambient light sensor disposed at least partially in the housing, and operable to (i) detect ambient light within a predetermined proximity to the device, and (ii) generate a light detection signal to cause one or more of the plurality of illumination elements to emit light if the ambient light becomes less than a predetermined level.

7. The device of claim 6, wherein, the ambient light sensor is configured to stop generating the light detection signal if the ambient light becomes greater than the predetermined level to cause the one or more of the plurality of illumination elements to stop emitting light.

8. The device of claim 1, wherein, the access panel is operable to be slidably secured to the wall mount.

9. The device of claim 1, wherein, each of the plurality of sections of the reconfigurable housing is configured to conform to a contour defined by a mounting surface of the device.

10. A method of retrofitting an illumination device to a wall, the method comprising the steps of:

configuring a reconfigurable housing based on a contour of a wall; and mounting the housing on the wall, wherein, the housing is operable to assume one of a plurality of configurations, the housing includes a plurality of sections (i) connected via a connector, and (ii) configured to allow one of the plurality of sections to rotate relative to another one of the plurality of sections, and the housing includes at least one illumination element operable to emit light in at least one direction; wherein the plurality of sections of the housing includes two sections, and the at least one illumination element includes a plurality of illumination elements on each of the two sections; wherein the plurality of configurations includes two configurations with the sections extended from the connector at a forty-five degree angle relative to each other, with one of the two configurations enabling each of the plurality of illumination elements to emit light away from each other and another one of the two configurations enabling each of the plurality of lights to emit light toward each other; wherein a battery for powering the at least one illumination element is housed in a compartment within the housing and accessible via an access panel having a security feature, and the access panel is operable to be secured to a wall mount.

11. The method of claim 10, wherein, each of the plurality of illumination elements include a visor operable to limit light emitted by its respective one of the plurality of illumination elements.

12. The method of claim 10, wherein, the housing includes a lens operable to enclose one or more of the plurality of illumination elements.

13. The method of claim 10,
wherein,
the housing includes a motion sensor and a light sensor.

* * * * *